US006536051B1

(12) United States Patent
Oh

(10) Patent No.: US 6,536,051 B1
(45) Date of Patent: Mar. 25, 2003

(54) SOCK WITH AN ANKLE-LOCATED SUPPORT

(76) Inventor: Nam H. Oh, 11 Northridge Way, Warren, NJ (US) 07059

( * ) Notice: Subject to any disclaimer, the term of this patent is extended or adjusted under 35 U.S.C. 154(b) by 0 days.

(21) Appl. No.: 10/057,872

(22) Filed: Jan. 29, 2002

(51) Int. Cl.[7] ..... A43B 17/00
(52) U.S. Cl. ..... 2/239
(58) Field of Search ..... 2/239, 240, 241, 2/242, 409, 61; 66/178 A, 178 R, 183, 172 E; 602/63, 62

(56) References Cited

U.S. PATENT DOCUMENTS

| | | | | |
|---|---|---|---|---|
| 1,806,963 A | | 5/1931 | Woods | |
| 3,039,282 A | | 6/1962 | Hayes | |
| 4,172,456 A | | 10/1979 | Zens | |
| D269,477 S | | 6/1983 | Brier | |
| 4,397,161 A | | 8/1983 | Chesebro, Jr. et al. | |
| 4,422,307 A | | 12/1983 | Thorneburg | |
| 4,561,267 A | | 12/1985 | Wilkinson et al. | |
| 5,095,548 A | | 3/1992 | Chesebro, Jr. | |
| 5,103,656 A | * | 4/1992 | Hanson, II | 66/185 |
| D329,324 S | | 9/1992 | Stokely | |
| 5,403,265 A | | 4/1995 | Berguer et al. | |
| 5,617,745 A | * | 4/1997 | Della Corte et al. | 66/178 |
| 5,771,495 A | * | 6/1998 | Turner et al. | 2/239 |
| 5,867,839 A | | 2/1999 | Lawlor | |
| 6,012,177 A | * | 1/2000 | Cortinovis | 2/239 |
| 6,092,397 A | * | 7/2000 | Cortinovis | 66/184 |
| 6,173,452 B1 | | 1/2001 | Kelly et al. | |
| 6,209,141 B1 | | 4/2001 | Adeli | |
| 6,286,151 B1 | * | 9/2001 | Lambertz | 2/239 |
| 6,446,267 B1 | * | 9/2002 | Shah | 2/239 |

* cited by examiner

*Primary Examiner*—John J. Calvert
*Assistant Examiner*—Alissa L. Hoey
(74) *Attorney, Agent, or Firm*—Donald R. Schoonover

(57) ABSTRACT

A sock includes a foot covering section that covers a wearer's foot when the sock is worn and a tube section that extends over the wearer's ankle and part way up the wearer's calf when the sock is worn. The tube section has a top rim located near the wearer's calf. A sock supporting band of elastic material or the like is located in the tube section near the ankle of the wearer when the sock is worn. The sock supporting band is spaced apart from the top rim of the sock and is located to engage the ankle of the wearer whereby the sock is supported near the wearer's ankle rather than near the wearer's calf.

4 Claims, 3 Drawing Sheets

SOCK WITH AN ANKLE-LOCATED SUPPORT

BACKGROUND OF THE INVENTION

1. Field of the Invention

The present invention relates to the general art of wearing apparel, and to the particular field of stockings, and supporting features thereof.

2. Discussion of the Related Art

When wearing socks, many people experience discomfort caused by the elastic bands in socks near the top thereof and which are used to hold the sock up on the wearer's leg. Some socks locate this elastic band above the wearer's ankle, while others locate this elastic band on the wearer's calf. In either case, since the elastic band is located at the top of the sock, it must be fairly strong in order to maintain the sock in a desired position on the wearer. The strong elastic band can be uncomfortable and it can also interfere with circulation in the wearer's foot and leg.

Therefore, many people either roll down their socks or simply put up with the discomfort associated with the elastic bands in the socks.

Therefore, there is a need for a'sock that can be securely held in place on a wearer, yet will not create discomfort or interfere with circulation in the wearer's foot or leg.

Still further, many socks that are supported by elastic bands located at the top are not aesthetically appealing. It is also difficult to make such socks appealing due to the limitations associated with the location of the supporting band.

Therefore, there is a need for a sock that is amenable to various designs while still being securely supported on the wearer.

It is also observed that when a sock is supported by an elastic band located at the top of the sock, that elastic band will be located on the calf of a wearer. Since most socks extend to near the lower portion of the wearer's calf, there is an inclined surface against which the elastic band presses. This surface is inclined downwardly toward the wearer's foot. This downward inclination biases the sock to cause the sock to slip down the wearer's leg. This is generally countered by making the elastic band tighter. However, tightening the elastic band will exacerbate the above-discussed problems associated with impairing circulation and/or leaving pressure marks on the wearer.

Therefore, there is a need for a sock that can be securely held in place without requiring engaging the wearer in a location that is sloped or inclined in a manner that vitiates the support feature of the sock.

Some socks overcome this problem by making the sock longer. That is, the sock extends past the mid calf location of the wearer. This may solve one problem, but creates others because the sock may be more expensive to manufacture due to the added material with respect to shorter socks, and may people do not like to wear lengthy socks such as this, especially in hot weather.

Therefore, there is a need for a sock that can be securely supported on a wearer without requiring the sock to extend to a mid calf location on the wearer.

PRINCIPAL OBJECTS OF THE INVENTION

It is a main object of the present invention to provide a sock that can be securely held in place on a wearer, yet will not create discomfort or interfere with circulation in the wearer's foot or leg.

It is another object of the present invention to provide a sock that is amenable to various designs while still being securely supported on the wearer.

It is another object of the present invention to provide a sock that can be securely held in place without requiring engaging the wearer in a location that is sloped or inclined in a manner that vitiates the support feature of the sock.

It is another object of the present invention to provide a sock that can be securely supported on a wearer without requiring the sock to extend to a mid calf location on the wearer.

SUMMARY OF THE INVENTION

These, and other, objects are achieved by a sock that has the elastic used to support the sock on the wearer located near the ankle portion of the wearer when the sock is in place on the wearer. Positioning the elastic band adjacent to the ankle of the wearer and spaced from the top of the sock removes the pressure associated with the elastic band from the calf of the wearer and distributes this pressure in an area that will make that pressure comfortable and will not inhibit circulation. The ankle area of the wearer also is not inclined in a manner that tends to cause a sock to slip and thus the elastic band associated with the sock of the present invention need not be as strong as socks using an elastic band in the top portion thereof. This makes the sock more comfortable than prior socks yet keeps the sock securely in place on the wearer. This also permits a sock to be shorter than socks that reach mid calf yet still keeps the sock securely in place on the wearer. A manufacturer need not produce large socks to satisfy those wearers who require their socks to be held securely in place.

Other forms of the sock include a secondary band of elastic material located near the top rim of the sock; however, this secondary band of elastic material will be loose and will not inhibit circulation since the primary support for the sock will be associated with the band of elastic located near the ankle so the secondary band of elastic material can be loose and comfortable. Moisture absorbing material can be located inside the sock and the band or bands of elastic material can be various colors to add to the aesthetic appeal of the sock.

DETAILED DESCRIPTION OF THE INVENTION

Other objects, features and advantages of the invention will become apparent from a consideration of the following detailed description and the accompanying drawings.

The sock of the present invention permits a wearer to have a snugly fitting sock without affecting the circulation around his or her foot and while remaining comfortable. The supporting element for the sock is positioned in the location that is most advantageous to securely supporting the sock.

Figure 1:
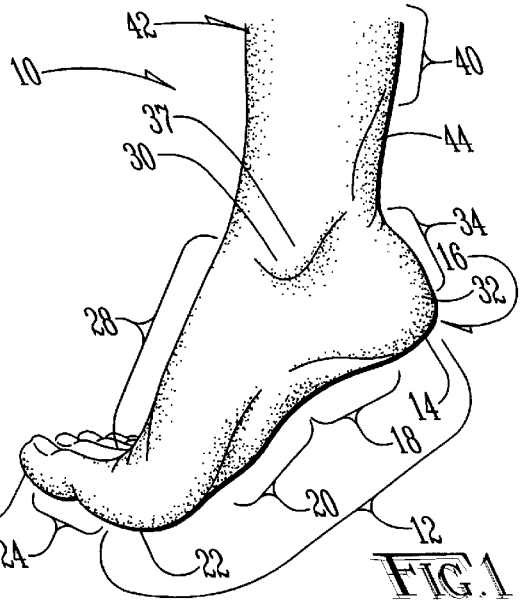
FIG. 1 is a perspective view of a wearer's foot.

Referring first to FIG. 1, it is seen that the sock of the present invention 10 is worn on a wearer's foot, which has a sole portion 12 upon which the wearer's weight is supported while walking or standing. Sole portion 12 includes a heel portion 14 positioned at a rearmost location 16 of the wearer's foot, a plantar arch 18 extending in a forward direction from heel portion 14, a metatarsal arch 20 extending in the forward direction from plantar arch 18, a ball 22 of the wearer's foot extending in the forward direction from metatarsal arch 20, and a transverse arch 24 extending in the forward direction from the ball of the wearer's foot.

The wearer's foot further includes a toe portion 26 positioned at a forwardmost location of the wearer's foot and extending from transverse arch 24, an instep portion 28 extending in a rearward direction from the wearer's toe portion 26 toward the heel portion 14 of the wearer's foot, an ankle joint/medial malleolus 30 of the wearer's foot located near instep portion 28 of wearer's foot 10, a heel rear section 32 located in a rear area 34 of the wearer's foot and extending from ankle joint/medial malleolus 30 of the wearer's foot downward toward sole portion 12 of the wearer's foot. As can be seen in FIG. 1, ankle joint/medial malleolus 30 has an upper surface 37 that slopes upwardly from the foot portion.

A calf section 40 of the wearer's leg 42 extends upwardly from ankle joint medial malleolus 30, and an Achilles' tendon area 44 of the wearer's foot is positioned between calf section 40 of the wearer's leg 42 and heel portion 14 of the wearer's foot and near the ankle joint/medial malleolus 30 of the wearer's foot.

Heel rear section 32 extends from the Achilles' tendon area 44 to heel portion 14 of sole portion 12 of the wearer's foot.

Figure 2:
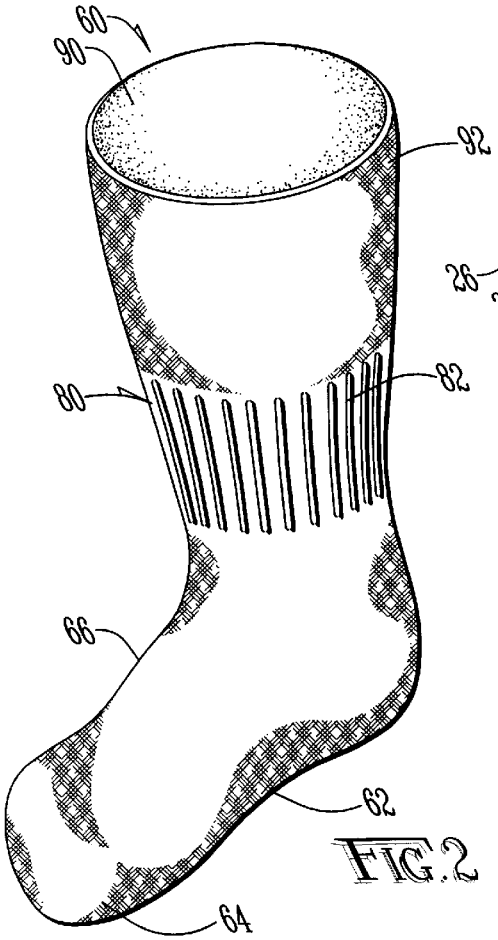
FIG. 2 is a perspective view of a sock embodying the teaching of the present invention.
Figure 3:
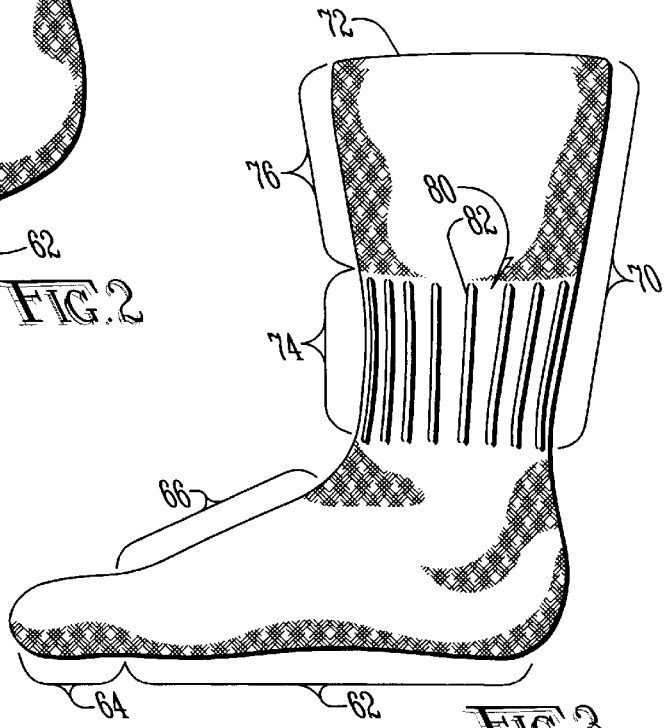
FIG. 3 is a side elevational view of the sock shown in FIG. 2.

Referring next to FIGS. 2 and 3, the combination embodying the present invention further includes a sock 60 having a foot sole portion 62 covering the sole portion 12 of the wearer's foot when the sock is in place on the wearer's foot from heel rear section 32 to toe portion 26 of the wearer's foot, a toe portion 64 covering toe portion 26 of the wearer's foot when sock 60 is in place on the wearer's foot, and an instep portion 66 covering instep portion 28 of the wearer's foot when sock 60 is in place on the wearer's foot. Sock 60 further includes a body 70 which extends from instep portion 66 of sock 60 upwardly along calf portion 40 of wearer's leg 42 when sock 60 is in place on the wearer's foot. Sock body 70 includes a top rim 72 on body 70 of sock 60 and which is positioned on wearer's calf 40 when sock 60 is in place on the wearer's foot, an ankle portion 74 that covers ankle joint/medial malleolus 30 and Achilles' tendon portion 44 of the wearer's foot when sock 60 is in place on the wearer's foot, and a calf portion 76 that covers a portion of the wearer's calf 40 between ankle portion 74 of sock 60 and top rim 72 of sock 60 when sock 60 is in place on the wearer's foot.

An elastic band 80 is positioned in ankle portion 74 of sock 60 and is spaced from top rim 72 of body 70 of sock 60 and is spaced from instep portion 66 of sock 60 to be located only in the area adjacent to ankle joint/medial malleolus 30 and Achilles' tendon 44 of the wearer's foot when sock 60 is in place on the wearer's foot. Elastic band 80 is integral and one-piece with the material of sock 60 and has a diameter that is smaller than the outer diameter of the wearer's foot adjacent to the calf of the wearer's foot whereby the elastic band presses the sock against the wearer's ankle, especially against upwardly sloping surface 31 when the sock is in place on the wearer's foot. This pressure keeps the sock in place on the wearer without placing pressure on the sensitive areas.of the wearer's calf. The elastic band will thus keep the sock in place without the adverse effects discussed above that are associated with hosiery having an elastic band located near the top rim thereof. Ribbing 82 can be included if desired.

By comparing FIGS. 1 and 2, it can be understood that band 80 presses against upwardly sloping surface 31 of the ankle area 30 that actually slopes upwardly in a direction that will keep the sock up as opposed to pressing against the calf section 40 that actually slopes in a direction that tends to cause the sock to slip down on the wearer's foot. In this manner, it can be understood that the sock embodying the present invention is actually more securely held in place using lighter pressure against the wearer than prior art socks that place the pressure band adjacent to the top rim of the sock where the sock engages the downwardly sloping calf of the wearer.

Sock 60 further includes an inside surface 90 located adjacent to the wearer's skin when sock 60 is in place on the wearer's foot and an outside surface 92. The sock can be formed of cotton material such as is normally used in socks or other material as suitable to the style and intended use of the sock.

Figure 4:
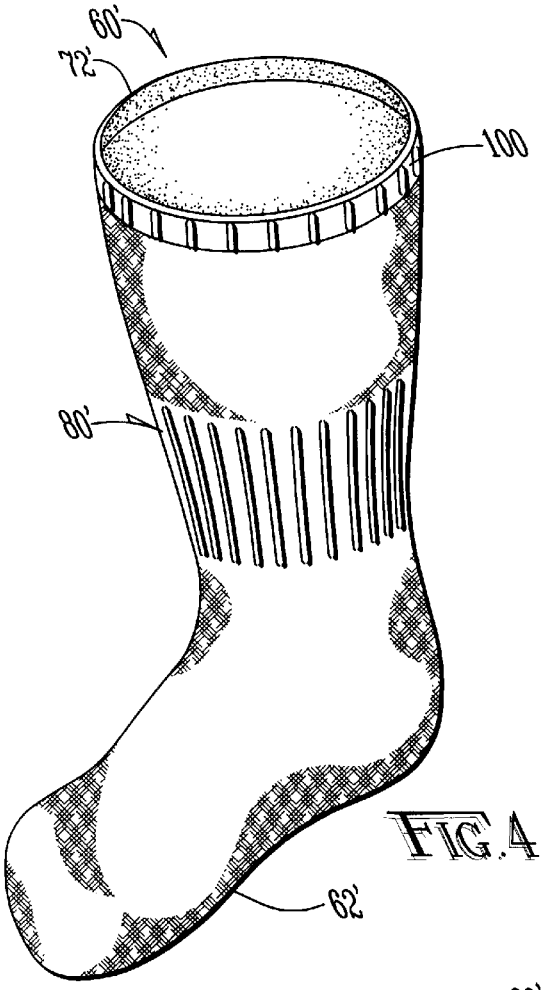
FIG. 4 is a perspective view of an alternative form of the sock embodying the present invention.
Figure 5:
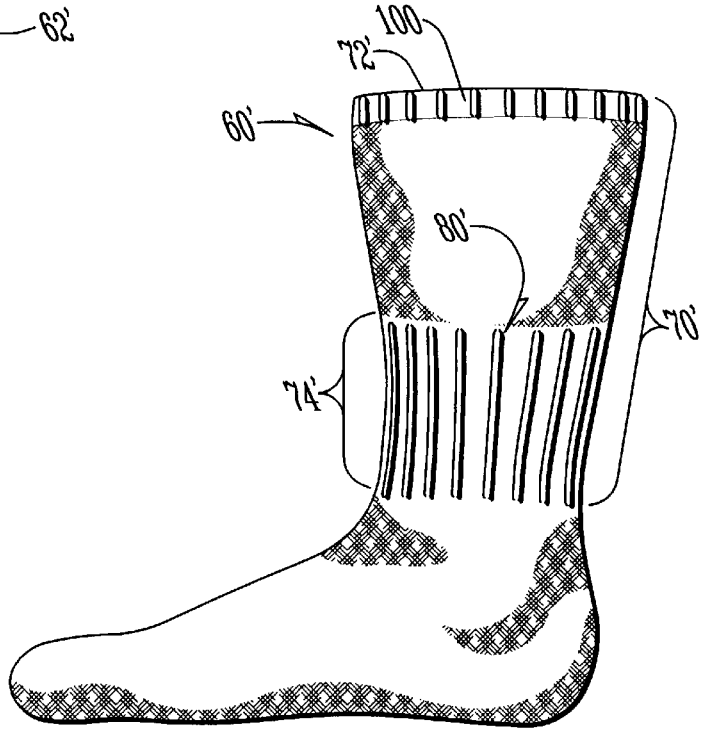
FIG. 5 is a side elevational view of the sock shown in FIG. 4.

An alternative form of the sock is shown in FIGS. 4 and 5. Sock 60' includes a further elastic band 100 positioned adjacent to top rim 72' of sock body 70' and spaced from elastic band 80' positioned near ankle joint/medial malleolus 30 of the wearer and extending downward from top rim 72' toward ankle section 74' for a short distance as determined by aesthetics. Elastic band 100 is a secondary source of support and thus does not have to be as strong as band 80 which is the primary source of support for sock 60'. Elastic band 100 has a diameter that is smaller than the outer diameter of the wearer's calf adjacent to top rim 72' of sock 60'.

Figure 6:
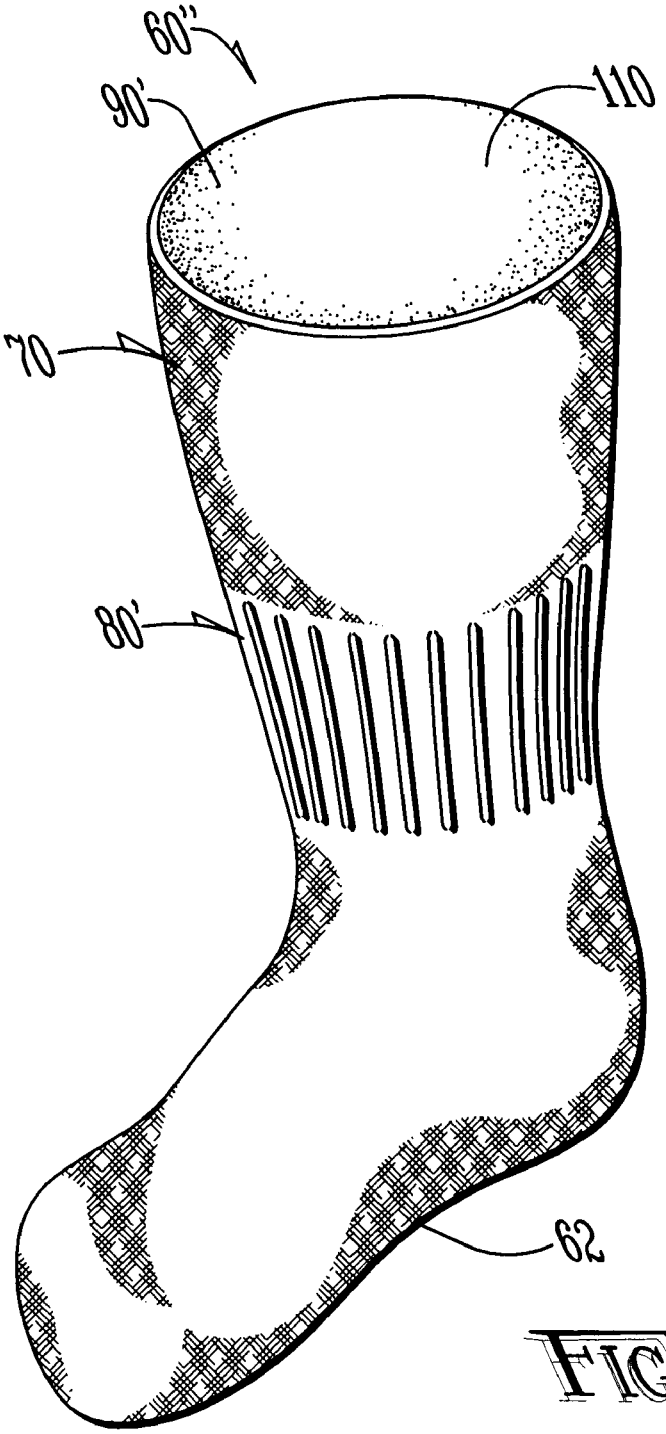
FIG. 6 is a perspective view of another alternative form of the sock embodying the teaching of the present invention.

A still further form of the sock embodying the present invention is shown in FIG. 6 as sock 60". Sock 60" includes a moisture absorbing liner 110 located on inner surface 90' of sock 60". Sock 60" also includes an elastic band 80 and can also include a further elastic band 100 if desired. The elastic bands can be any color or shape that is suitable for the sock and can be different colors if desired.

It is understood that while certain forms of the present invention have been illustrated and described herein, it is not to be limited to the specific forms or arrangements of parts described and shown.

I claim:

1. A sock comprising:

(1) a foot sole portion covering a sole portion of a wearer's foot when said sock is in place on the wearer's foot from the heel rear section to the toe section of the wearer's foot, (2) a toe portion covering the toe portion of the wearer's foot when said sock is in place on the wearer's foot, (3) an instep portion covering the instep portion of the wearer's foot when said sock is in place on the wearer's foot, (4) a body which extends from the instep portion of said sock upwardly along the calf portion of the wearer's leg when said sock is in place on the wearer's foot, and which includes (A) a top rim on the body of said sock positioned on the wearer's calf when said sock is in place on the wearer's foot, (B) an ankle portion that covers the ankle joint/medial malleolus and the Achilles' tendon portion of the wearer's foot when said sock is in place on the wearer's foot, (C) a calf portion that covers a portion of the wearer's calf between the ankle portion of said sock and the top rim of said sock when said sock is in place on the wearer's foot, (D) an elastic band positioned in the ankle portion of said sock and spaced from the top rim of the body of said sock and spaced from the instep portion of said sock to be located only in the area adjacent to the ankle joint/medial malleolus and Achilles' tendon areas of the wearer's foot when said sock is in place on the wearer's foot, the elastic band having a diameter that is smaller than the outer diameter of the wearer's foot adjacent to the calf of the wearer's foot whereby the elastic band presses the sock against the wearer's calf when said sock is in place on the wearer's foot, said elastic band being integral and one-piece with the ankle portion of said sock, (E) an inside surface located adjacent to a wearer's skin when said sock is in place on the wearer's foot, and (F) an outside surface.

2. The sock as described in claim 1 further including a moisture absorbing liner located on the inner surface of said sock.

3. A sock comprising:

a) a foot covering section that encases a foot of a wearer when said foot covering section is in place on the foot of the wearer;

b) a tube section extending from said foot covering section upwardly along a calf of a wearer when said tube section is in place, said tube section having a top rim located on a calf of the wearer when said tube section is in place on the wearer and an ankle covering section that is located adjacent to an ankle of the wearer when said tube section is in place on the wearer; and c) a sock supporting band in said tube section in said ankle covering section spaced from the top rim and spaced from said foot covering section, the band structured to press only against the upward sloping area of the wearer's foot adjacent to the ankle joint/medial malleolus and the Achilles' tendon areas.

4. The sock as described in claim 3 wherein said sock supporting band is integral and one-piece with said tube section.

* * * * *